US010694295B2

(12) United States Patent
Seo et al.

(10) Patent No.: US 10,694,295 B2
(45) Date of Patent: Jun. 23, 2020

(54) ACOUSTIC DEVICE WITH IMPROVED ACOUSTIC PERFORMANCE

(71) Applicant: BUJEON CO., LTD., Ansan-si (KR)

(72) Inventors: Donghyun Seo, Ansan-si (KR); Minkoo Park, Ansan-si (KR); Halim Kim, Bucheon-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 16/248,715

(22) Filed: Jan. 15, 2019

(65) Prior Publication Data

US 2019/0238992 A1 Aug. 1, 2019

(30) Foreign Application Priority Data

Jan. 30, 2018 (KR) ..... 10-2018-0011032

(51) Int. Cl.

| | |
|---|---|
| ***H04R 9/06*** | (2006.01) |
| ***H04R 9/02*** | (2006.01) |
| ***H04R 7/18*** | (2006.01) |
| ***H04R 9/04*** | (2006.01) |

(52) U.S. Cl.

CPC ..... *H04R 9/06* (2013.01); *H04R 7/18* (2013.01); *H04R 9/025* (2013.01); *H04R 9/045* (2013.01)

(58) Field of Classification Search

CPC ..... H04R 9/06; H04R 9/025; H04R 9/045; H04R 7/18; H04R 7/20; H04R 7/127

See application file for complete search history.

(56) References Cited

U.S. PATENT DOCUMENTS

2010/0195863 A1* 8/2010 Fujimoto ..... H04R 9/041 381/409
2016/0212513 A1* 7/2016 Honda ..... H04R 31/006

FOREIGN PATENT DOCUMENTS

| | | | |
|---|---|---|---|
| JP | 2002-152885 | A | 5/2002 |
| JP | 2003-143676 | | 5/2003 |
| KR | 10-2008-0075781 | A | 8/2008 |

* cited by examiner

*Primary Examiner* — Sunita Joshi

(74) *Attorney, Agent, or Firm* — Korus Patent, LLC; Seong Il Jeon

(57) ABSTRACT

Disclosed herein is an acoustic device with improved acoustic performance. The acoustic device includes: a housing that forms the appearance of the acoustic device; a magnet that generates magnetic force; a yoke that includes paramagnetic material that concentrates the magnetic force; a voice coil that vibrates due to the magnetic force when an electric signal having sound information is applied; a diaphragm that comes into close contact with the voice coil and that vibrates and generates sound in response to the vibration of the voice coil; a plate that is located between the diaphragm and the magnet; and a locking ring that is located on the plate and that fastens part of the diaphragm, wherein the sectional surface of the locking ring has a rectangular shape the height of which is greater than the width thereof.

8 Claims, 10 Drawing Sheets

ACOUSTIC DEVICE WITH IMPROVED ACOUSTIC PERFORMANCE

CROSS-REFERENCE TO RELATED APPLICATION

This application claims the benefit of Korean Patent Application No. 10-2018-0011032 filed on Jan. 30, 2018, which is hereby incorporated by reference herein in its entirety.

BACKGROUND

1. Technical Field

The present invention relates generally to an acoustic device with improved acoustic performance. More specifically, the present invention relates to an acoustic device that improves sound pressure because the area of a vibrating portion is wide, that is assembled using a curling process without using an adhesive, and that improves output in a low frequency band because an internal volume is large.

2. Description of the Related Art

The description given in this section merely provides background information about the present invention, and does not constitute prior art.

An acoustic device, e.g., an earphone or speaker, is a device in which a voice coil is located in a gap between a magnet and a yoke in a magnetic circuit including the magnet and the yoke and, when an electric signal is applied to the voice coil, the voice coil vibrates and generates sound due to interaction with the magnetic circuit.

FIG. 1 is a view illustrating the sectional view of a conventional acoustic device.

As shown in FIG. 1, the conventional acoustic device includes a housing 100, a printed circuit board (PCB) circuit 110, a yoke 120, a magnet 130, a plate 140, a locking ring 150, a diaphragm 160, a voice coil 170, and a pressing member 180.

The housing 100 forms the appearance of the acoustic device. The housing 100 protects the PCB circuit 110, the yoke 120, the magnet 130, the plate 140, the locking ring 150, the diaphragm 160, the voice coil 170, and the pressing member 180 from external shocks, and increases customers' purchasing desires by improving aesthetics.

The PCB circuit 110 applies electric signals of an audio device to the voice coil 170. The PCB circuit 110 may be located inside or outside the housing 100 depending on the design of the acoustic device.

The magnet 130 is an object having magnetism, and generates magnetic force. The magnet 130 is preferably a permanent magnet. The magnet 130 may be formed in a ring shape or cylinder shape. The magnet 130 formed in a ring shape is referred to as an F type, and the magnet 130 formed in a cylinder shape is referred to as a P type.

The yoke 120 enables high-density, uniform magnetic force to be obtained by concentrating the magnetic force generated by the magnet 130. The yoke 120 is spaced apart from the magnet 130 by a predetermined interval.

When the magnet 130 has a ring shape and is of an F type, the yoke 120 may be formed in a cylinder shape in the center of the magnet 130. When the magnet 130 has a cylinder shape and is of a P type, the yoke 120 may be formed in a ring shape surrounding the magnet 130.

The voice coil 170 is located between the magnet 130 and the yoke 120. The magnetic force generated by the magnet 130 penetrates the voice coil 170. When an electric signal having sound information is applied to the voice coil 170 while the magnetic force is penetrating the voice coil 170, the voice coil 170 vibrates due to electromagnetic interaction with a magnetic circuit.

The diaphragm 160 is partially attached to the voice coil 170. Accordingly, when the voice coil 170 vibrates, the diaphragm 160 vibrates also and generates sound.

The plate 140 is located on the magnet 130, and functions as a frame configured to fasten the locking ring 150 and the diaphragm 160.

The locking ring 150 is attached to the upper end of the plate 140, and the pressing member 180 is attached to the lower end of the housing 100. The locking ring 150 and the pressing member 180 fasten the diaphragm 160 by pressing part of the diaphragm 160 in both directions. More specifically, the edge portion (hereinafter referred to as the "fastened portion") of the diaphragm 160 is inserted and fastened between the locking ring 150 and the pressing member 180, and the remaining portion (hereinafter referred to as the "vibrating portion") of the diaphragm 160 vibrates and generates sound.

In order to prevent the diaphragm 160 from falling when vibration is generated and sound is output, the area of the fastened portion needs to be sufficient. For example, when the approximately 0.35 mm portion of the edge of the diaphragm 160 is inserted and pressed between the locking ring 150 and the pressing member 180, the diaphragm 160 is prevented from falling. However, when the area of the fastened portion is excessively large, the area of the vibrating portion configured to vibrate and output sound is relatively small, and thus a problem arises in that sound pressure is reduced.

Various technologies for increasing the area of a vibrating portion in a diaphragm while securely fastening the edge portion of the diaphragm are disclosed. As a related document, there is Korean Utility Model Registration No. 20-0432596 entitled "Speaker" and published on Nov. 28, 2006.

The above document discloses a speaker including a yoke configured to sequentially accommodate a magnet and a magnet plate, a coil configured to vibrate due to magnetic force generated by the magnet and the magnet plate and connected to an external PCB terminal through a lead wire, and a diaphragm integrated with the coil and configured to vibrate and reproduce sound in response to the vibration of the coil, wherein an outer wall is formed along the circumference of one end portion of the yoke, an accommodation space configured to sequentially accommodate the magnet and the magnet plate is formed by the outer wall, and a stepped portion that is open upward and that has a predetermined height and width is formed on the inner circumference of the outer wall through cutting, thereby further providing a space, within which both ends of the diaphragm vibrate vertically, by means of the stepped portion.

In the speaker disclosed in the above document, the area of a vibrating portion in the diaphragm is increased by changing the structure of the yoke. However, the technology disclosed in the above document is problematic in that a molding process for changing the structure of the yoke is required and the structural change of the yoke may adversely affect the acoustic performance of the speaker.

SUMMARY

An object of the present invention is to provide an acoustic device that improves sound pressure.

An object of the present invention is to provide an acoustic device that is assembled without using an adhesive.

An object of the present invention is to provide an acoustic device that improves output in a low frequency band.

The objects of the present invention are not limited to those mentioned above, and other objects that are not mentioned herein will be clearly understood by a person skilled in the art from the following description.

According an aspect of the present invention, there is provided an acoustic device, including: a housing that forms the appearance of the acoustic device; a magnet that generates magnetic force; a yoke that includes paramagnetic material that concentrates the magnetic force; a voice coil that vibrates due to the magnetic force when an electric signal having sound information is applied; a diaphragm that comes into close contact with the voice coil and that vibrates and generates sound in response to the vibration of the voice coil; a plate that is located between the diaphragm and the magnet; and a locking ring that is located on the plate and that fastens part of the diaphragm, wherein the sectional surface of the locking ring has a rectangular shape the height of which is greater than the width thereof.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Embodiments of the present invention will be described in detail below via the exemplary drawings. It should be noted that when reference symbols are assigned to components, the same reference symbols will be assigned to the same components as much as possible even when the components are shown in different drawings. Furthermore, in the following description of the embodiments of the present invention, when it is determined that a detailed description of a related well-known configuration or function may make the gist of the present invention obscure, the detailed description will be omitted.

In the following description of the components of the present invention, symbols, such as first, second, i), ii), (a), (b), etc., may be used. These are used merely to distinguish one component from another, and are not intended to limit the essentials, order or sequence of the components. Furthermore, throughout the specification and the claims, when any portion is described as "including" or "comprising" any component, this does not mean that the portion excludes another component, but means that the portion may include another component, unless otherwise clearly specified.

1. First Embodiment

Figure 2:
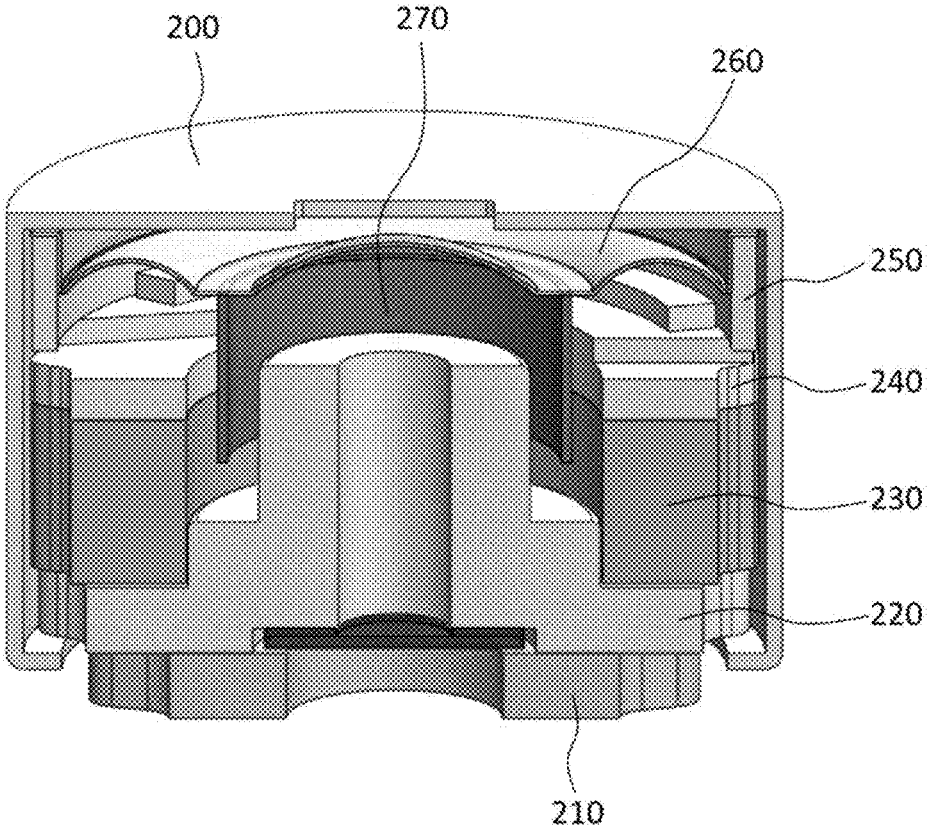
FIG. 2 is a sectional view of an acoustic device according to a first embodiment of the present invention.

FIG. 2 is a sectional view of an acoustic device according to a first embodiment of the present invention.

As shown in FIG. 2, the acoustic device according to the first embodiment of the present invention includes a housing 200, a PCB circuit 210, a yoke 220, a magnet 230, a plate 240, a locking ring 250, a diaphragm 260, and a voice coil 270.

The housing 200 forms the appearance of the acoustic device. The housing 200 protects the PCB circuit 210, the yoke 220, the magnet 230, the plate 240, the locking ring 250, the diaphragm 260, the voice coil 270, and a pressing member from external shocks, and increases customers' purchasing desires by improving aesthetics. Furthermore, the housing 200 according to the first embodiment of the present invention has a curled structure in order to minimize the use of an adhesive during assembly. This will be described in detail later.

The PCB circuit 210 applies electric signals of an audio device to the voice coil 270. The PCB circuit 210 may be located inside or outside the housing 200 depending on the design of the acoustic device. Although the PCB circuit 210 according to the first embodiment of the present invention is described as being located beneath the yoke 220, the PCB circuit 210 may be disposed at various locations other than the location beneath the yoke 220. Since the structure and location of the PCB circuit 210 are not main features of the present invention, detailed descriptions thereof will be omitted.

The magnet 230 is an object having magnetism, and generates magnetic force. The magnet 230 is preferably a permanent magnet. The magnet 230 may be formed in a ring shape or cylinder shape.

For convenience sake, the following description will be given with a focus on an F-type acoustic device in which the magnet 230 has a ring shape. However, it will be apparent that the technical spirit of the present invention may be also applied to a P-type acoustic device.

The yoke 220 enables high-density, uniform magnetic force to be obtained by concentrating the magnetic force generated by the magnet 230. The yoke 220 is made of paramagnetic material, such as iron (Fe) or the like. The paramagnetic material is material that is weakly magnetized in the direction of a magnetic field when it is placed in a magnetic field and that is not magnetized when a magnetic field is removed.

The yoke 220 is spaced apart from the magnet 230 by a predetermined interval. When the magnet 230 has a ring shape, the yoke 220 may be formed in a cylinder shape in the center of a ring. When the magnet 230 has a cylinder shape, the yoke 220 may be formed in a ring shape surrounding the magnet 230.

The acoustic device according to the first embodiment of the present invention is an acoustic device having a structure in which the yoke 220 has a cylinder shape, the magnet 230 has a ring shape surrounding the yoke 220 and the voice coil 270 is disposed inside the magnet 230.

However, the technical spirit of the present invention may be also applied to an acoustic device having a structure in which the magnet 230 has a cylinder shape, the yoke 220 has a ring shape surrounding the magnet 230, and the voice coil 270 is disposed outside the magnet 230.

The voice coil 270 is located between the magnet 230 and the yoke 220. The magnetic force generated by the magnet 230 penetrates the voice coil 270. When an electric signal having sound information is applied to the voice coil 270 while the magnetic force is penetrating the voice coil 270, the voice coil 270 vibrates due to electromagnetic interaction with a magnetic circuit.

The diaphragm 260 is partially attached to the voice coil 270. Accordingly, when the voice coil 270 vibrates, the diaphragm 260 vibrates also and generates sound. Since the portion where the diaphragm 260 and the voice coil 270 are attached to each other is not a main feature of the present invention, a detailed description thereof will be omitted.

The plate 240 is located on the magnet 230, and functions as a frame configured to fasten the locking ring 250 and the diaphragm 260.

The locking ring 250 is attached to the upper end of the plate 240. The acoustic device according to the first embodiment of the present invention is different in the shape of the locking ring 250 from the conventional acoustic device. Although the sectional surface of the locking ring 250 of the conventional acoustic device has a square shape, as shown in FIG. 1, the sectional surface of the locking ring 250 of the acoustic device according to the first embodiment of the present invention has a rectangular shape the height of which is greater than the width thereof.

Figure 1:
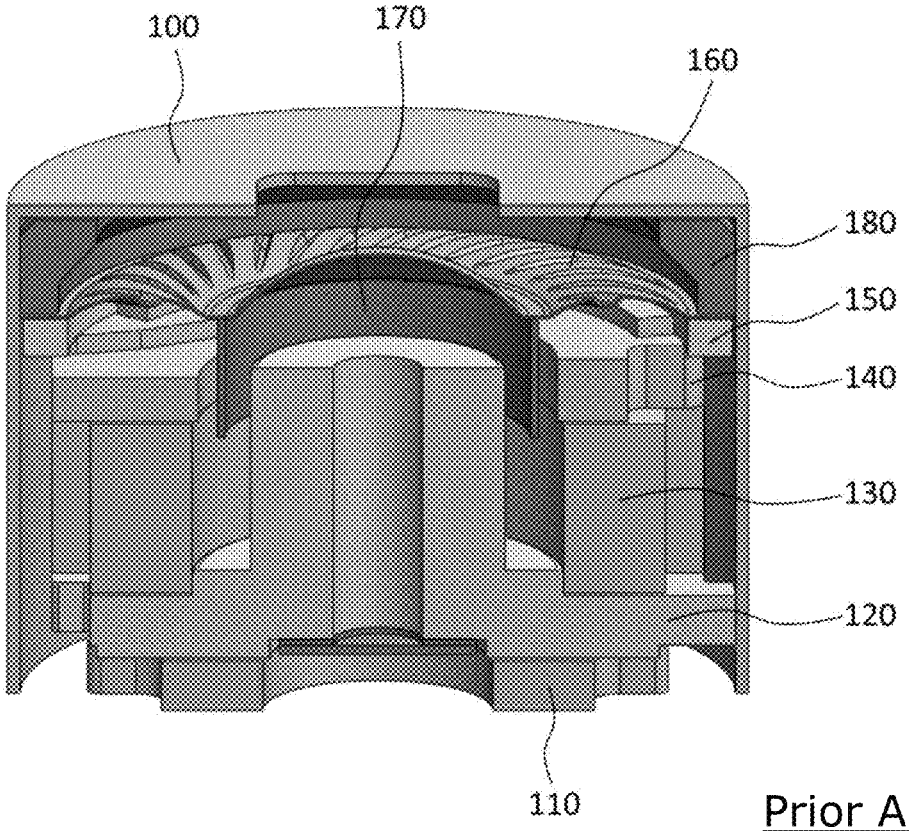
Prior Art FIG. 1
FIG. 1 is a view illustrating the sectional view of a conventional acoustic device.

The conventional acoustic device shown in FIG. 1 is configured such that the height of the locking ring 150 is low, and thus the separate pressing member 180 is provided, so that the locking ring 150 supports the diaphragm 160 below the diaphragm 160 and the pressing member 180 fastens the edge of the diaphragm 160 by pressing the diaphragm 160 from a location above the diaphragm 160.

However, the acoustic device according to the first embodiment of the present invention is configured such that the sectional surface of the locking ring 250 has a rectangular shape, the locking ring 250 supports the diaphragm 260 without a pressing member, and the housing 200 fastens the edge of the diaphragm 260 by pressing the diaphragm 260 from a location above the diaphragm 260.

As described above, in order to prevent the diaphragm 260 from falling when vibration is generated, the area of the fastened portion of the diaphragm 260 needs to be sufficient. The acoustic device according to the first embodiment of the present invention is configured such that the sectional surface of the locking ring 250 has a rectangular shape the height of which is greater than the width thereof, and thus the area of the portion of the diaphragm 260 that is inserted and fastened between the upper end surface of the locking ring 250 and the housing 200 is smaller than that of the conventional acoustic device. Accordingly, it is necessary that the additional portion of the diaphragm 260 is attached to the inner surface of the locking ring 250 and thus an additional fastening area is secured.

The additional portion of the diaphragm 260 and the inner surface of the locking ring 250 are attached to each other by using an adhesive. A sufficient fastening area is secured by fastening the additional portion of the diaphragm 260 to the inner surface of the locking ring 250 by using an adhesive or the like. Accordingly, when vibration is generated, vibration shocks are absorbed, and the diaphragm 260 is prevented from falling.

In summary, the acoustic device according to the first embodiment of the present invention is configured such that a part of the diaphragm 260 comes into close contact with the upper end surface of the locking ring 250 and another part of the diaphragm 260 comes into close contact with the inner surface of the locking ring 250. More specifically, a part of the diaphragm 260 may come into contact with all of the upper end surface of the locking ring 250, and another part of the diaphragm 260 may come into close contact with part of the inner surface of the locking ring 250.

In connection with a method of achieving close contact, a part of the diaphragm 260 may be fastened by being inserted and pressed between the upper end surface of the locking ring 250 and the housing 200. Furthermore, a part of the diaphragm 260 may be fastened to the inner surface of the locking ring 250 by attaching the part of the diaphragm 260 to the inner surface of the locking ring 250 by using an adhesive.

Figure 3:
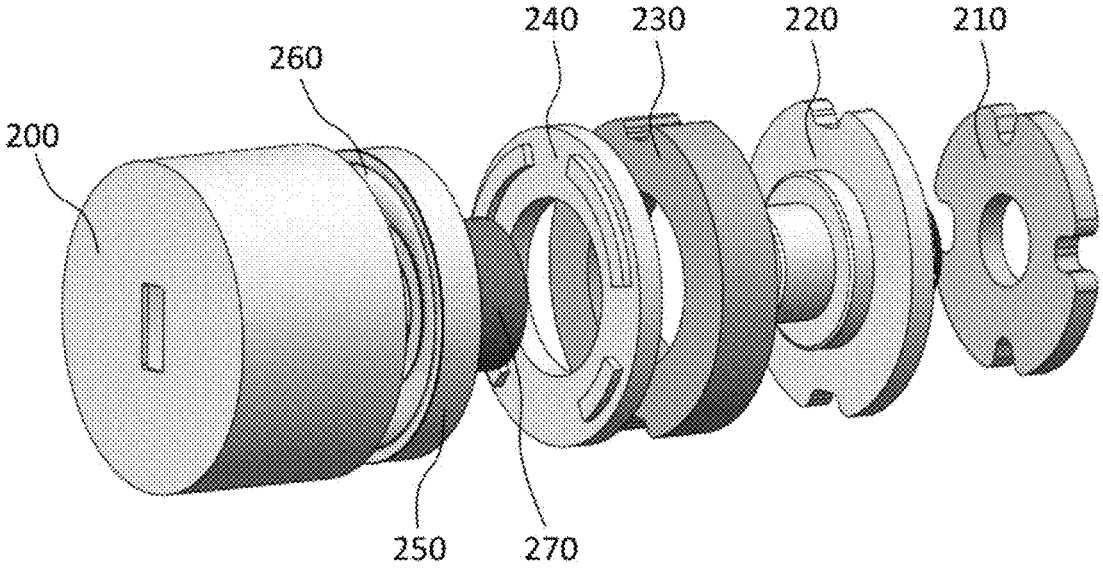
FIG. 3 is a coupling view of the acoustic device according to the first embodiment of the present invention.
Figure 4:
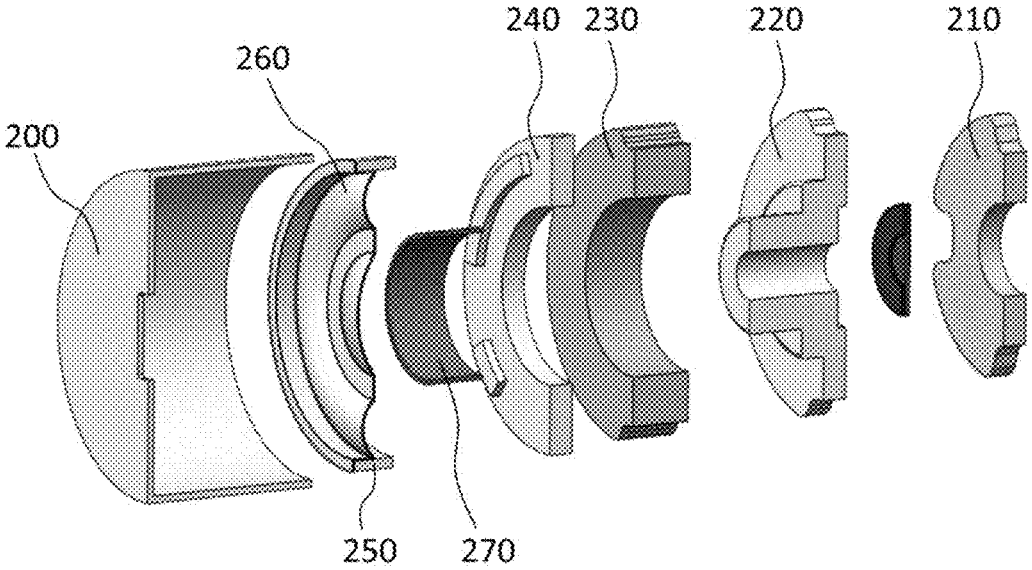
FIG. 4 is a view showing the sectional surfaces of the coupling view illustrated in FIG. 3.

FIG. 3 is a coupling view of the acoustic device according to the first embodiment of the present invention, and FIG. 4 is a view showing the sectional surfaces of the coupling view illustrated in FIG. 3.

As shown in FIGS. 3 and 4, the acoustic device according to the first embodiment of the present invention is assembled in the sequence of the housing 200, the diaphragm 260, the locking ring 250, the voice coil 270, the plate 240, the magnet 230, the yoke 220, and the PCB circuit 210.

During an assembly process, part of the edge of the diaphragm 260 is inserted and fastened between the housing 200 and the locking ring 250.

Figure 5:
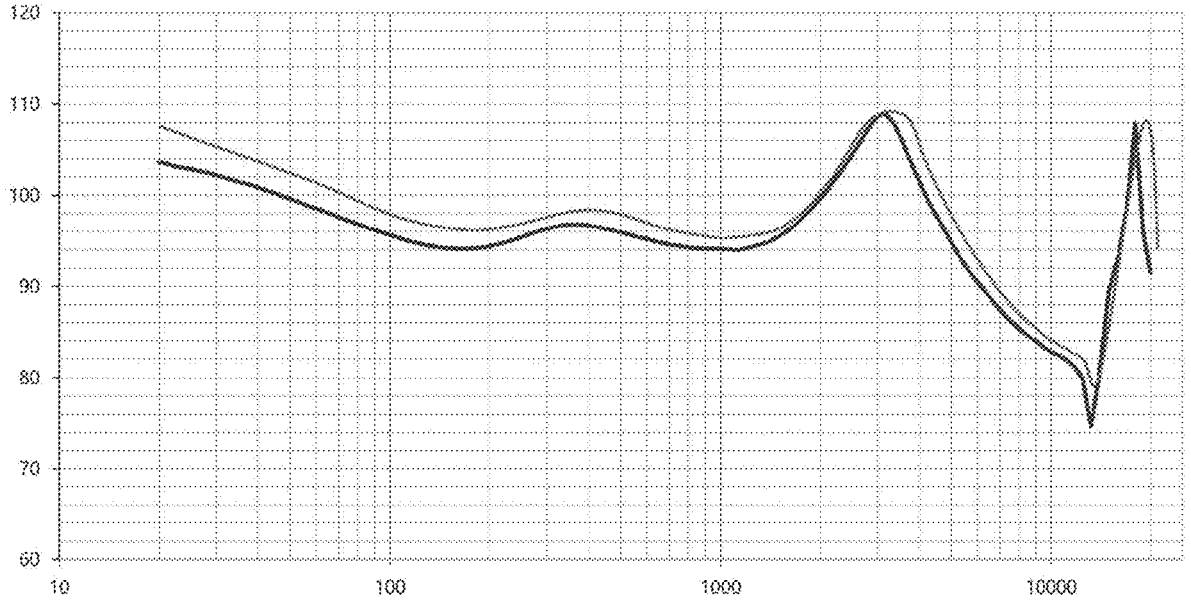
FIG. 5 is a graph illustrating the acoustic performance test results of the acoustic device according to the first embodiment of the present invention.

FIG. 5 is a graph illustrating the acoustic performance test results of the acoustic device according to the first embodiment of the present invention.

In the graph of FIG. 5, the x axis represents the magnitude of frequency, and the y axis represents the strength of output. In FIG. 5, the blue curve represents the acoustic performance test results of the conventional acoustic device, and the red curve represents the acoustic performance test results of the acoustic device according to the first embodiment of the present invention.

As shown in FIG. 5, it can be seen that the acoustic device according to the first embodiment of the present invention exhibited improved output all over the frequency band as the area of the vibrating portion of the diaphragm 260 increased.

Figure 6:
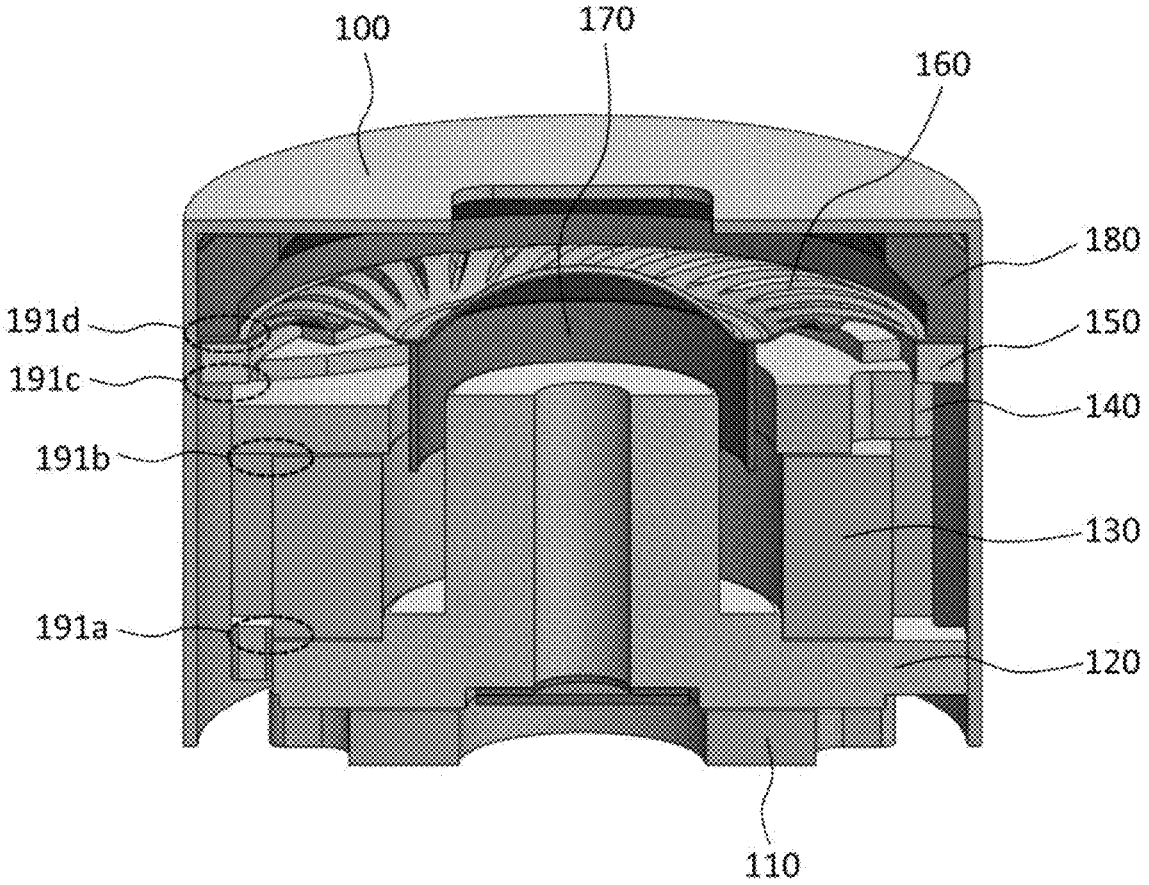
FIG. 6 is a view illustrating a method of fastening components of the conventional acoustic device.

FIG. 6 is a view illustrating a method of fastening components of the conventional acoustic device.

As shown in FIG. 6, in the conventional acoustic device, the components thereof are fastened to one another by bonding them by means of an adhesive.

More specifically, in the conventional acoustic device, the yoke 120 and the magnet 130 are bonded to each other by using an adhesive at 191*a*, the magnet 130 and the plate 140 are bonded to each other by using an adhesive at 191*b*, the plate 140 and the locking ring 150 are bonded to each other by using an adhesive at 191*c*, and the locking ring 150 and the diaphragm 160 are bonded to each other and the diaphragm 160 and the pressing member are bonded to each other by using an adhesive at 191*d*.

The conventional acoustic device is problematic in that the manufacturing process thereof is complex because the components thereof are fastened to one another by using an adhesive, and is also problematic in that the defect rate thereof is high because an adhesive overflows during a process of bonding the components by applying the adhesive to small areas. In particular, when the locking ring 150 and the diaphragm 160 are bonded to each other and the diaphragm 160 and the pressing member are bonded to each other, an adhesive needs to be applied to narrow portions of the edge of the diaphragm 160. Accordingly, the adhesive overflows easily and contaminates the diaphragm 160, with the result that a problem arises in that acoustic performance is degraded.

Figure 7:
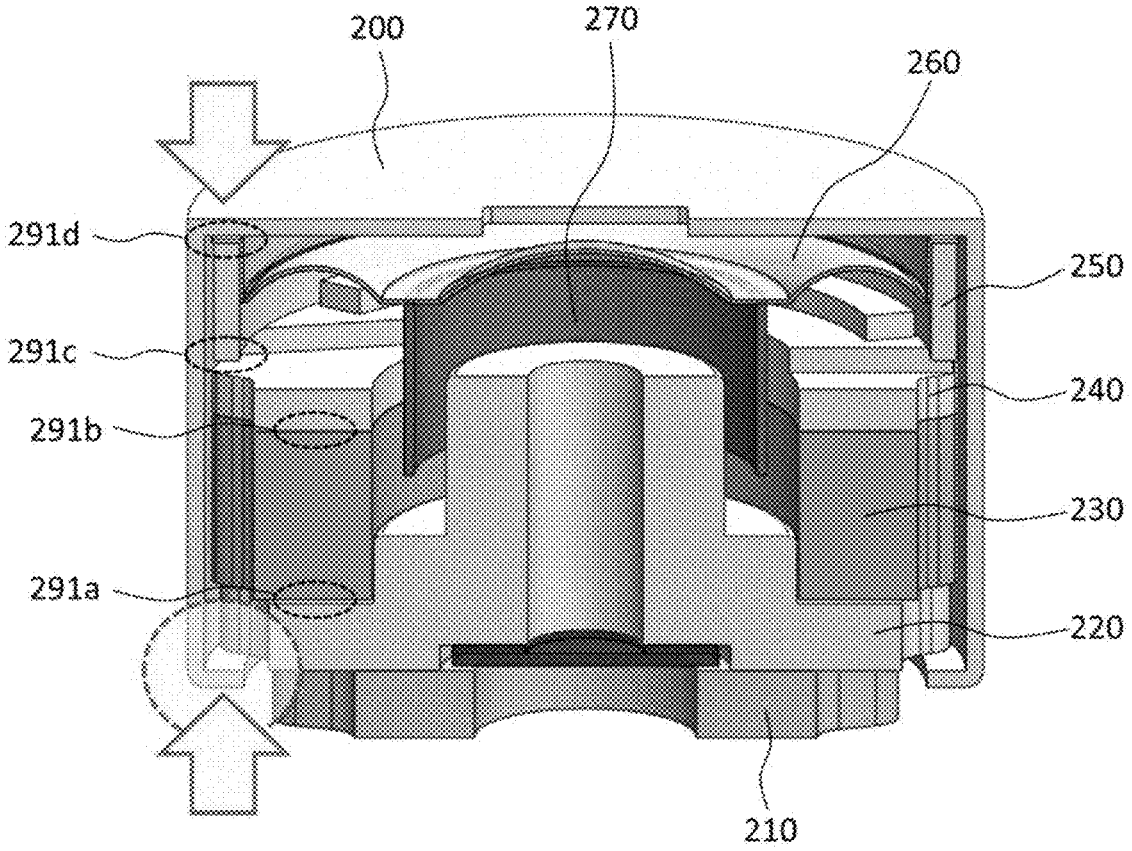
FIG. 7 is a view illustrating a method of fastening components of the acoustic device according to the first embodiment of the present invention.

FIG. 7 is a view illustrating a method of fastening the components of the acoustic device according to the first embodiment of the present invention.

As shown in FIG. 7, in the acoustic device according to the first embodiment of the present invention, the components are fastened by curling an end of the housing 200. More specifically, in the acoustic device according to the first embodiment of the present invention, the components may be fastened to one another without using an adhesive by curling the end of the housing 200 in a state in which the yoke 220, the magnet 230, the plate 240, the locking ring 250, and the diaphragm 260 have been brought into contact with one another and pressing the yoke 220, the magnet 230, the plate 240, the locking ring 250, and the diaphragm 260 in both directions.

In the acoustic device according to the first embodiment of the present invention, the components are fastened by using a curling process, and thus the components may be fastened without using sealing and an adhesive bond. As a result, the complexity of the process attributable to the use of the adhesive and defect rate attributable to the use of the adhesive may be reduced, and thus overall yield may be also improved.

Meanwhile, as described above, in order to prevent the diaphragm 260 from falling when vibration is generated, the area of the fastened portion of the diaphragm 260 needs to be sufficient. In the acoustic device according to the first embodiment of the present invention, the sectional surface of the locking ring 250 has a rectangular shape the height of which is greater than the width thereof, and thus the area of the portion of the diaphragm 260 inserted and fastened between the upper end surface of the locking ring 250 and the housing 200 is narrow. Accordingly, it is necessary that a sufficient fastening area is secured by fastening the additional portion of the diaphragm 260 to the inner surface of the locking ring 250. Since the additional portion of the diaphragm 260 and the inner surface of the locking ring 250 are not fastened even when the end of the housing 200 is curled, the additional portion of the diaphragm 260 and the inner surface of the locking ring 250 are preferably fastened using an adhesive.

2. Second Embodiment

Figure 8:
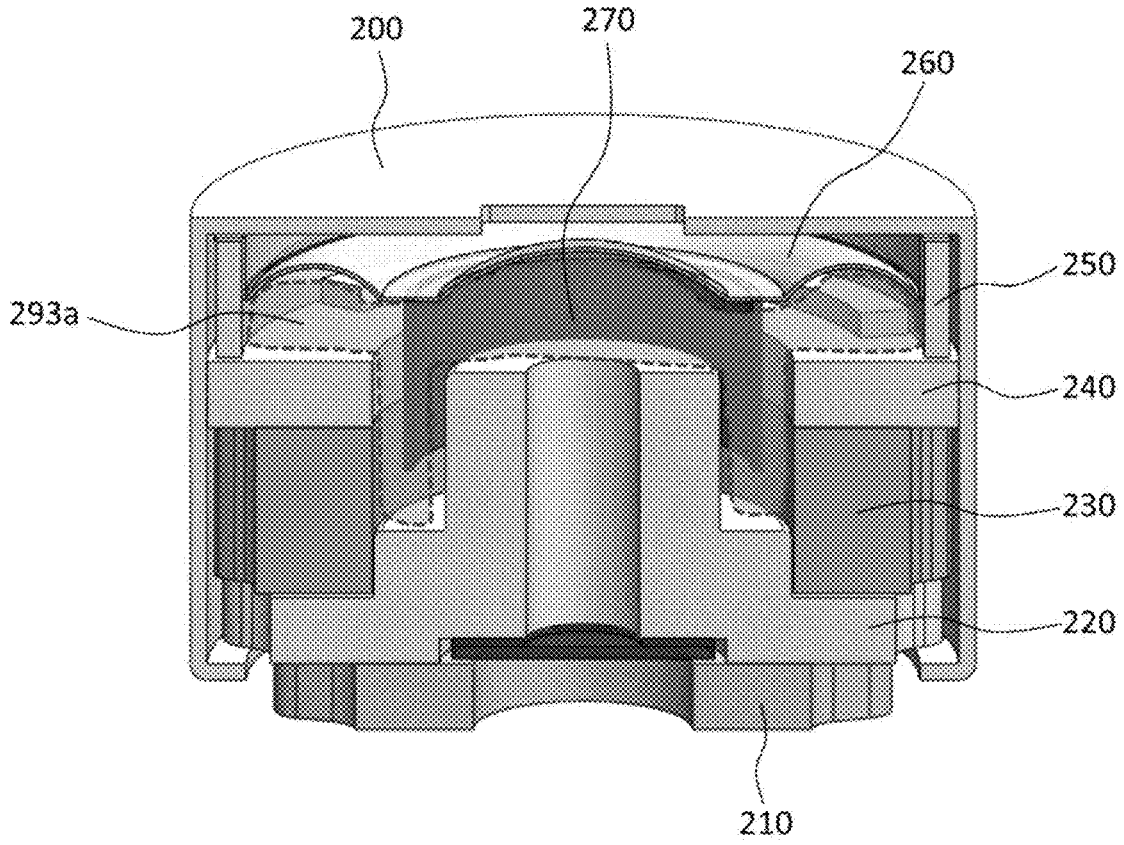
FIG. 8 is a view illustrating the inside of the acoustic device according to the first embodiment of the present invention.

FIG. 8 is a view illustrating the inside of the acoustic device according to the first embodiment of the present invention.

In the acoustic device according to the first embodiment of the present invention, an empty space 293*a* is present among the diaphragm 260, the plate 240, the magnet 230, and the yoke 220. A resonance is generated within the empty space 293*a* formed inside the diaphragm 260. A resonance having desirable tone is generated in a specific frequency band depending on the size of the space.

When the space formed inside the diaphragm 260 is smaller, a resonance is generated in a higher frequency band, and thus output in the higher frequency band is enhanced. In contrast, when the space formed inside the diaphragm 260 is larger, a resonance is generated in a lower frequency band, and thus output in the lower frequency band is enhanced. Since important sound information, such as the voice of a person, the sound of a song, or the like, is generally concentrated in a low frequency band, it is necessary to increase output in a low frequency band. For this purpose, it is necessary to widen the space formed inside the diaphragm 260.

Figure 9A:
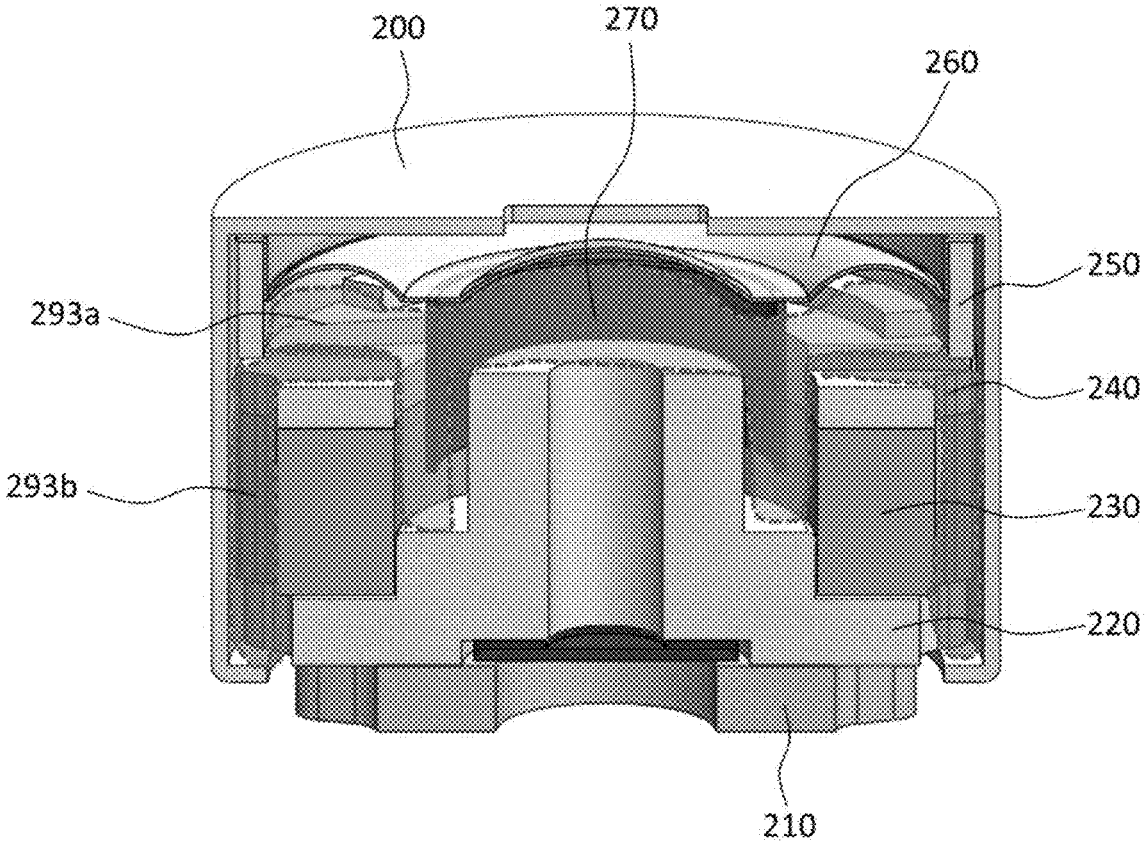
FIGS. 9*a* and 9*b* are views illustrating the inside of an acoustic device according to a second embodiment of the present invention.
Figure 9B:
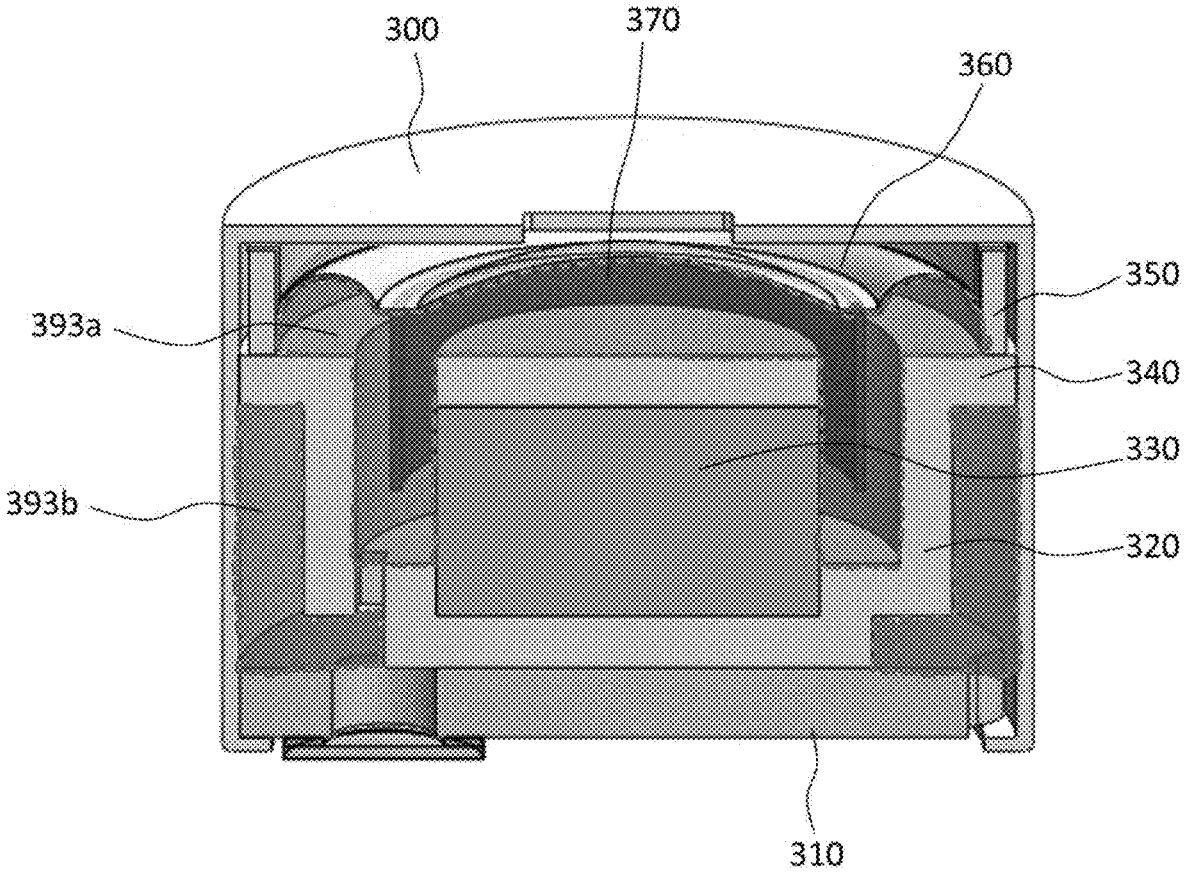

FIGS. 9*a* and 9*b* are views illustrating the inside of an acoustic device according to a second embodiment of the present invention.

In the acoustic device, a basic space 293*a* is basically present below a diaphragm 260. As shown in FIG. 9*a*, in the acoustic device according to the second embodiment of the present invention, an additional space 293*b* may be additionally formed between a magnet 230 and a housing 200 or between a yoke 220 and a housing 200. Furthermore, a path configured to communicate with the additional space 293*b* may be formed in the plate 240.

As shown in FIG. 9*b*, in the case of a P-type acoustic device, an additional space 393*b* may be formed between the yoke 320 and the housing 300 in addition to the basic space 393*a*. Furthermore, a path configured to communicate with the additional space 393*b* may be formed in the plate 340.

Via the above structure, in the acoustic device according to the second embodiment of the present invention, the basic space 293*a* or 393*a* and the additional space 293*b* or 393*b* are connected to each other, with the result that the overall volume of the inside of the acoustic device is increased.

In the acoustic device according to the second embodiment of the present invention, an internal space formed inside the diaphragm 260 or 360 is increased by securing the additional space 293*b* or 393*b*, and thus a resonance is generated in a lower frequency band than that in the acoustic device according to the first embodiment of the present invention, with the result that output in the lower frequency band may be enhanced.

Figure 10:
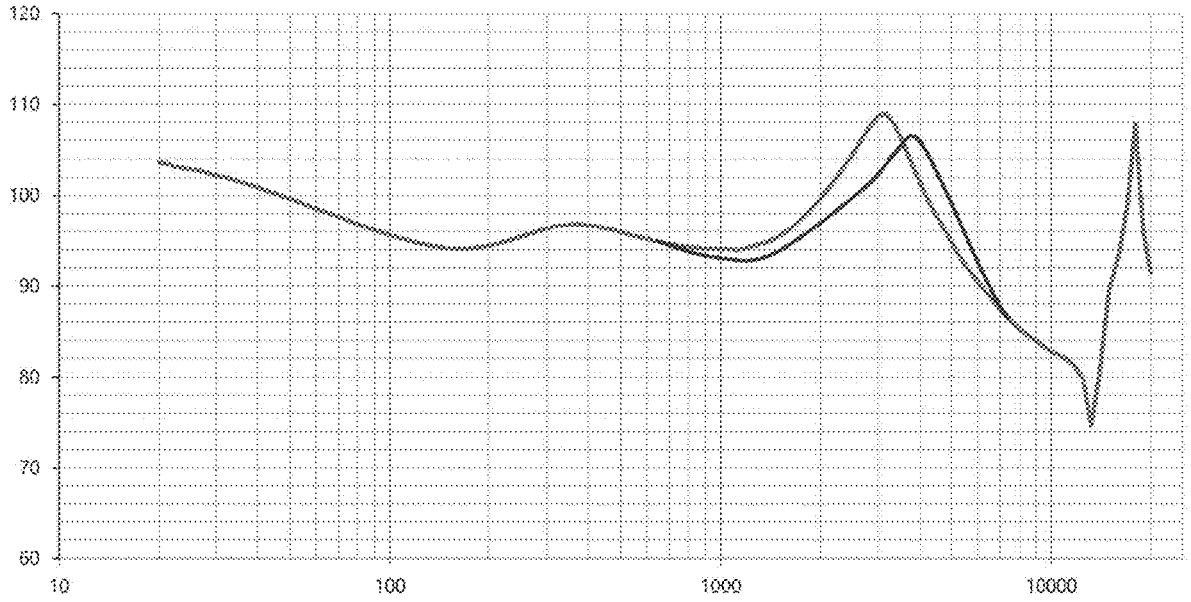
FIG. 10 is a graph illustrating the acoustic performance test results of the acoustic device according to the second embodiment of the present invention.

FIG. 10 is a graph illustrating the acoustic performance test results of the acoustic device according to the second embodiment of the present invention.

In the graph of FIG. 10, the x axis represents the magnitude of frequency, and the y axis represents the strength of output. In FIG. 10, the blue curve represents the acoustic performance test results of the acoustic device according to the first embodiment of the present invention, and the red curve represents the acoustic performance test results of the acoustic device according to the second embodiment of the present invention.

As shown in FIG. 10, it can be seen that in the acoustic device according to the second embodiment of the present invention, output in a low frequency band was enhanced by securing the additional space configured to perform resonance control compared to output in the acoustic device according to the first embodiment of the present invention.

The acoustic device according to an embodiment of the present invention improves sound pressure by increasing the area of the vibrating portion in the diaphragm.

The acoustic device is assembled using a curling process without using an adhesive.

The acoustic device improves output in a low frequency band by increasing an internal volume in order to perform resonance control.

The above embodiments are intended merely to illustrate the technical spirit of the present invention. It will be apparent to those having ordinary knowledge in the part to which the present invention pertains that various modifications and alterations may be made to the above embodiments without departing from the essential features of the present invention.

The embodiments are not intended to limit the technical spirit of the present invention, but are intended to illustrate the technical spirit of the present invention. Accordingly, the scope of the present invention is not limited by the embodiments. The scope of the present invention is defined by the attached claims. All technical spirits identical or equivalent to the claims should be construed as being included in the scope of the present invention.

What is claimed is:

1. An acoustic device, comprising:

a housing that forms an appearance of the acoustic device;

a magnet that generates magnetic force;

a yoke that includes paramagnetic material that concentrates the magnetic force;

a voice coil that vibrates due to the magnetic force when an electric signal having sound information is applied;

a diaphragm that comes into close contact with the voice coil and that vibrates and generates sound in response to the vibration of the voice coil;

a plate that is located between the diaphragm and the magnet; and a locking ring that is located on the plate and that fastens part of the diaphragm, wherein a sectional surface of the locking ring has a rectangular shape a height of which is greater than a width thereof, wherein the part of the diaphragm comes into close contact with the locking ring, and wherein the part of the diaphragm is inserted and fastened between an upper end surface of the locking ring and the housing.

2. The acoustic device of claim 1, wherein the part of the diaphragm comes into close contact with all of an upper end surface of the locking ring and part of an inner surface of the locking ring.

3. An acoustic device, comprising:

a housing that forms an appearance of the acoustic device;

a magnet that generates magnetic force;

a yoke that includes paramagnetic material that concentrates the magnetic force;

a voice coil that vibrates due to the magnetic force when an electric signal having sound information is applied;

a diaphragm that comes into close contact with the voice coil and that vibrates and generates sound in response to the vibration of the voice coil;

a plate that is located between the diaphragm and the magnet; and a locking ring that is located on the plate and that fastens part of the diaphragm, wherein a sectional surface of the locking ring has a rectangular shape a height of which is greater than a width thereof, wherein the part of the diaphragm comes into close contact with the locking ring, and wherein the part of the diaphragm is bonded and fastened to the inner surface of the locking ring.

4. The acoustic device of claim 1, wherein the voice coil is disposed inside the magnet.

5. The acoustic device of claim 1, wherein the voice coil is disposed outside the magnet.

6. An acoustic device, comprising:

a housing that forms an appearance of the acoustic device;

a magnet that generates magnetic force;

a yoke that includes paramagnetic material that concentrates the magnetic force;

a voice coil that vibrates due to the magnetic force when an electric signal having sound information is applied;

a diaphragm that comes into close contact with the voice coil and that vibrates and generates sound in response to the vibration of the voice coil;

a plate that is located between the diaphragm and the magnet; and a locking ring that is located on the plate and that fastens part of the diaphragm, wherein a sectional surface of the locking ring has a rectangular shape a height of which is greater than a width thereof, and wherein an end of the housing is curled and fastens the diaphragm, the locking ring, the plate, the magnet, and the yoke through pressing.

7. The acoustic device of claim 1, wherein an additional space is formed between the magnet and the housing or between the yoke and the housing.

8. The acoustic device of claim 7, wherein a path that communicates with the additional space is formed in the plate.

* * * * *